US005087908A

United States Patent [19]

Sanders, Jr.

[11] Patent Number: 5,087,908

[45] Date of Patent: Feb. 11, 1992

[54] PORTABLE ALARM SYSTEM WITH AUTOMATIC OPERATING STATE TRANSFERRAL

[75] Inventor: William A. Sanders, Jr., Jacksonville, Fla.

[73] Assignee: Homes Beautiful Investment & Service Co., Jacksonville, Fla.

[21] Appl. No.: 464,451

[22] Filed: Jan. 12, 1990

[51] Int. Cl.[5] ..... G08B 13/18

[52] U.S. Cl. ..... 340/567; 340/527; 340/528; 340/691

[58] Field of Search ..... 340/567, 541, 528, 527, 340/691

[56] References Cited

U.S. PATENT DOCUMENTS

| | | | |
|---|---|---|---|
| 4,151,520 | 4/1979 | Full | 340/528 |
| 4,335,376 | 6/1982 | Marquardt | 340/547 |
| 4,422,068 | 12/1983 | Helft et al. | 340/514 |
| 4,427,975 | 1/1984 | Kinzie | 340/691 |
| 4,797,657 | 1/1989 | Vorzimmer et al. | 340/541 |

OTHER PUBLICATIONS

Mountain West Alarm Supply Co., *Catalog A-80*, p. 6, Phoenix, AZ, 1979.

*Primary Examiner*—Glen R. Swann, III

*Attorney, Agent, or Firm*—Arthur G. Yeager

[57] ABSTRACT

A portable security alarm system includes a rechargeable battery and an infrared sensor to detect the presence of an intruder in a protected area. Three time delays are provided to allow the user to exit without setting off the alarm; to allow a legitimate user to disarm the system upon entry; and to limit the time that the alarm will sound. The system can only be disarmed by the entry of a multi-digit code that is kept secret whereas the device can be armed by anyone. The system is specifically designed to be resistant to spurious signals associated with electrical storms and is also designed to minimize power consumption. The system further includes circuitry to shutdown the alarm system when the voltage is low enough to risk damage to the battery. There are indicators associated with system operation including low voltage warning.

24 Claims, 2 Drawing Sheets

PORTABLE ALARM SYSTEM WITH AUTOMATIC OPERATING STATE TRANSFERRAL

BACKGROUND OF THE INVENTION

1. Field of the Invention

The present invention relates to portable security alarm systems and, in particular, to alarm systems with coded or secure disarm methods designed for use in isolated locations with minimum power requirements.

2. Prior Art

There is a wide variety of portable security alarm systems known to the prior art. These systems may employ audio and visual alarm functions. There are two principal disadvantages with existing systems. First, the alarms are of the low volume type because they are adapted for use in areas where they will be within hearing distance of friendly personnel. These systems are therefore unsuitable for use in isolated or unmonitored areas devoid of friendly personnel. Second, the arm and disarm methods employed are usually a simple mechanical switch to arm and disarm the system by turning off the power to the system. This arrangement allows any one with access to the system to disable the alarm functions.

What is most desired in a security system for unmonitored areas where friendly people are not close to the system is both a very loud alarm that can be heard some distance away and a secure disarming method that allows only a limited number of authorized persons to disable the alarm function. In addition, the system should be operable via a self-contained power supply for a substantial period of time. The present invention is specifically designed to accommodate the conflicting objectives of a very loud alarm with minimum power requirements. The alarm system should include design features that recognize the possibility of electrical storms and resulting circuit interference such as false alarms. Finally, the system should have the capability of rearming itself to the monitoring mode after one or more alarm cycles as well as providing indication that an alarm condition has occurred.

Representative alarm systems of the prior art include U.S. Pat. Nos. 4,151,520 (Full) and 4,335,376 (Marquardt). In the Full device, once the alarm is activated, it will remain on until the arming switch is turned off or until the batteries run down. The Marquardt device can also run down unless the triggering mechanism, in this case a door switch, is reversed by closing the door. The Marquardt device can then be reactivated by a subsequent intrusion. Neither device includes either circuitry to minimize power consumption or a secure disarming method.

In Helft, et al., U.S. Pat. No. 4,422,068, an indication of a prior alarm actuation is provided by an indicating light. This is a useful feature but it is not accompanied by circuitry to return the system to standby or monitoring after the alarm function has been terminated. The Helft device also lacks a secure disarming method.

None of the devices in the prior art deal with the need to minimize the power requirements of the system nor do they include specific design features to minimize spurious electrical transients resulting from electrical storms and the like.

BRIEF SUMMARY OF THE INVENTION

In one aspect of the present invention there is provided a portable security alarm system for detecting the presence of an intruder in a protected area which includes a battery, an output terminal circuit means for receiving power from the battery, and switching circuit means connected between the battery and the output terminal circuit means for selectively controlling power to the output terminal circuit means. An alarm circuit means has an alarm connected to and selectively energized by the battery and electronic circuit means connected to and selectively receiving power from the output terminal circuit means and connected to the alarm circuit means for selective energization of the alarm by the battery. The electronic circuit means includes detecting circuit means for detecting the presence of an intruder in the protected area and providing a first output signal in response thereto, and also includes a control circuit means responsive to the first output signal for selectively operating the system in one of a plurality of states and selectively transferring the system from one state to another state. The plurality of states are defined as an alarm state wherein the alarm is energized for a first time period in response to the detection of an intruder by the detection circuit means, a monitoring state wherein the system is responsive to the detection of an intruder by the detection circuit means and being transferable to the alarm state only after a second time period, and an arming state wherein the alarm is incapable of being energized during a third time period. The control circuit means includes reset circuit means to limit the length of time the system is in the alarm state to the first time period to reduce the power consumption of the system by the alarm and resetting the system to the monitoring state when the first time period is terminated by the reset circuit means. The switching circuit means is selectively operable to provide power from the battery to the output terminal circuit means. The electronic circuit means is energized when power is applied to the output terminal circuit to allow the system to be operated selectively in the plurality of states by the control circuit means.

According to a further aspect of the invention the electronic circuit means also includes a battery voltage sensing circuit to provide visual indication when the voltage of the battery falls below a predetermined low voltage value as established by the battery voltage sensing circuit. The battery voltage circuit includes an oscillator and a light source connected thereto which is operated in an ON-OFF duty cycle of approximately 20%–80% respectively to reduce the power consumption of the system when the sensing circuit means is providing indication that the voltage of the battery is below the low voltage value. The electronic circuit means further includes indicating circuit means for providing a visual indication that the system has been operated in the alarm state which has an oscillator and a light source connected thereto and is operated in an ON-OFF duty cycle of approximately 20%–80% respectively to reduce the power consumption of the system.

Another aspect of the present invention is seen wherein the alarm is energized only for a predetermined first time period as established by the control circuit means which includes energy conserving circuit means to reduce the power consumption of the system by limiting the length of time the system is in the alarm state to the first predetermined time period. A battery voltage sensing circuit means is operable to remove power from the electronic circuit means from the battery when the output voltage of the battery falls below a first predetermined low voltage cutoff value as established by the sensing circuit. The sensing circuit means includes state-sensitive circuit means operatively connected to be responsive to the control circuit means transferring the system to the alarm state for changing the low voltage cutoff value from the first predetermined value to a second predetermined value when the control circuit means transfers the system to the alarm state.

Other aspects of the invention provide a control circuit means which includes a first time delay circuit means for operating the system in the alarm state during the first time period as established by the first delay circuit means and providing an alarm output signal to the alarm circuit means for energizing the alarm for the duration of the first time period. The first time delay circuit means includes first reset circuit means to reset the first time delay circuit means to terminate the alarm output signal and transfer the system to the monitoring state after the completion of the first time period. The control circuit means includes second time delay circuit means operative in response to the first output signal when the system is in the monitoring state and providing an alarm lockout signal to the first time delay circuit means for the duration of the second period to prevent the first time delay circuit means from providing the alarm output signal during the second time period. The second time delay circuit means operates in an entry mode during the second time period and operates in an armed mode prior to the entry mode when the system is being operated in the monitoring state and includes reset circuit means to reset the second time delay circuit means to the armed mode at the end of the second time period, without providing the alarm lockout signal. In yet another aspect of the present invention the control circuit means includes a programmable circuit means connected to the switching circuit means and having manual entry means for providing an arming signal in response to a first predetermined method of operation of the manual entry means as programmed in the programmable circuit means. The switching circuit means is responsive to the arming signal to provide power from the power source to the output terminal circuit means when the arming signal is received.

Further aspects are seen wherein the control circuit means includes third time delay circuit means for operating the system in the arming state during the third time period as established by the third time delay circuit means. The third time delay circuit means provides a second alarm lockout signal to the first time delay circuit means for the duration of the third time period to prevent the first time delay circuit means from providing an alarm output signal during the third time period. The third time delay circuit means is responsive to the application of power to the electronic circuit means by the switching circuit means to begin the third time period when the arming signal is provided to the switching circuit means by the programmable circuit means and provides a state transfer signal at the end of the third time period to operate the system in the monitoring state. The second time delay circuit means is responsive to the state transfer signal to operate the system in the monitoring state after receiving the signal and terminating the second alarm lockout signal at the end of the duration of the third time period. The second time delay circuit means provides a second state transfer signal at the end of the second time period to operate the system in the alarm state, the first time delay circuit means being responsive to the second state transfer signal. The control circuit means includes state reset circuit means to transfer the system to the monitoring state at the end of duration of the first time delay period.

Also the invention includes the provision of the programmable circuit means in which a reset command signal is provided to the switching circuit means in response to a second predetermined method of operation of the manual entry means as programmed in the programmable circuit means and the switching circuit means is responsive to it to remove power from the output terminal circuit. The programmable circuit means is defined by a programmable digital controller.

The detection circuit means, according to this invention, preferably includes an infrared detector for providing the first output signal when the presence of an intruder is detected as a temperature change in a protected area, or a motion detector may be employed for providing the output signal when the presence of an intruder is detected as motion within a protected area.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE PREFERRED EMBODIMENT

Figure 1:
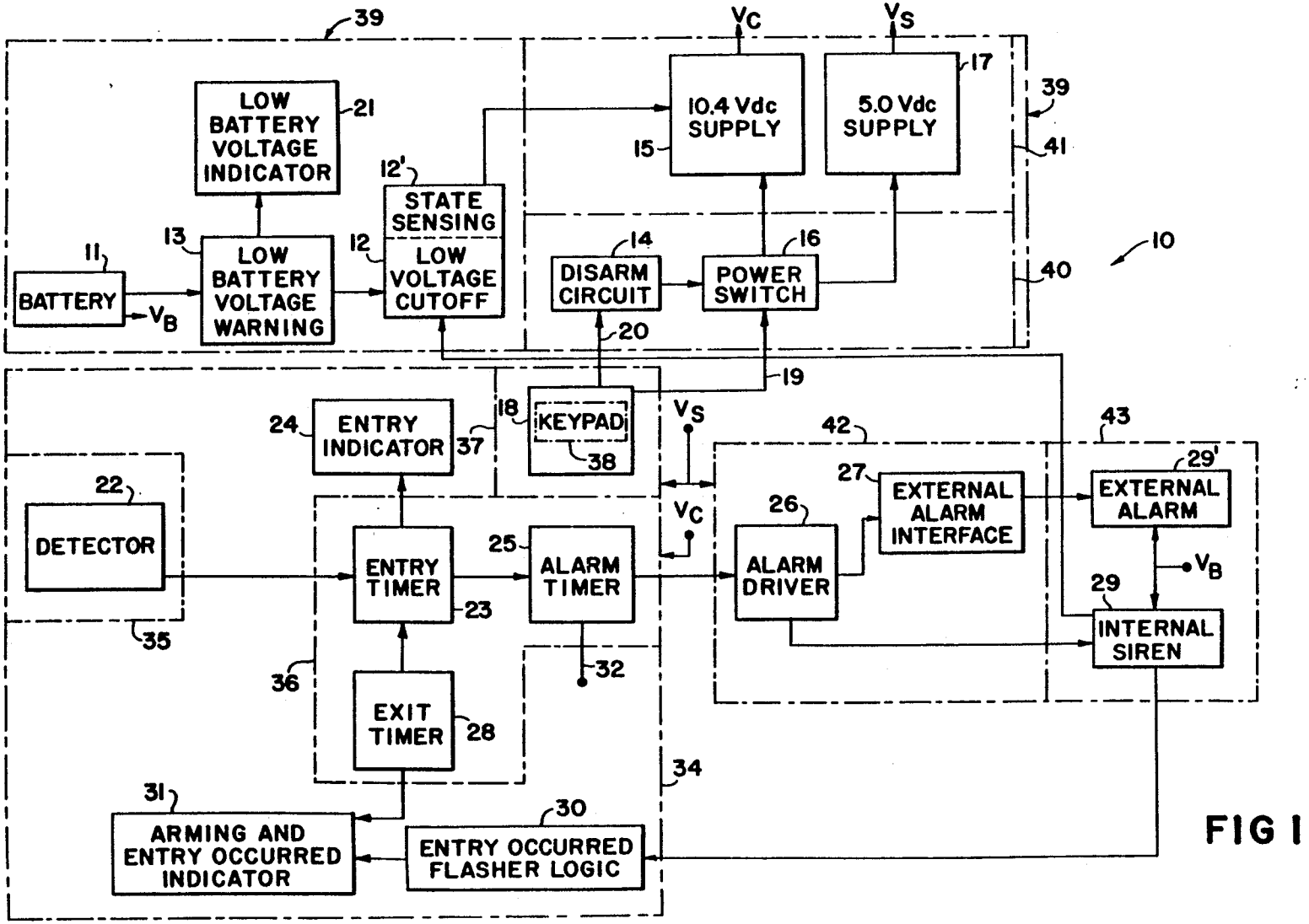
FIG. 1 is a simplified block diagram of the portable security system in accord with the present invention.

With reference now to the drawings, the portable security alarm in accord with the present invention is depicted generally at numeral 10 in FIG. 1. The system 10 includes a self-contained power source in the form of a 12 volt battery 11 which supplies voltage regulators 15 and 17 via low voltage cutoff circuit 12 and low voltage warning circuit 13 having indicator 21. The voltage regulators 15 and 17 are interconnected with disarm circuit 14 and power switch 16 which are operated by output control signals placed on lines 20 and 19 by keypad 18.

The alarm system 10 is energized by depressing keys on keypad 18 to place an arming command pulse on line 19 which allows power to supply 17, which then powers the various control and timing circuits, one of which is exit timer 28. Exit timer 28 provides an output signal for thirty seconds which allows the person in the protected area a sufficient period to leave the area without initiating an alarm function. The thirty-second exit timer delay is the arming mode and during this time the arming and entry occurred indicator 31 will be a steady green light.

Once the system 10 is armed at the completion of the exit timer 28 delay, an intruder will be sensed by detector 22 which sends an output signal to entry timer 23 which is now operable due to the time-out of exit timer 28. Entry timer 23 provides a thirty second time delay during which time the intruder must disable the alarm system 10 by generating a reset command pulse on line 20 for the disarm circuit 14 via keypad 18. If the proper 3-or 4- digit code is not entered on keypad 18 in thirty seconds the entry timer 23 times out, providing an output signal to alarm timer 25. Alarm timer 25 sends a signal to the alarm driver 26 for a period of twenty minutes during which time internal siren 29 and optional external alarm 29', connected via interface 27, will be energized by power from batter 11. When alarm timer 25 turns on, entry occurred flasher 30 will provide a flashing green light which is locked in. The system 10 will reset to the armed or monitoring state where it is capable of detecting a subsequent intruder at which time the entry and alarm functions will repeat the above cycle.

The low voltage cutoff circuit 12 will trip the circuitry on low voltage to protect the battery 11 from excessive discharge. Low voltage warning circuit 13 indicates via yellow light 21 that the battery 11 should be recharged.

Figure 2:
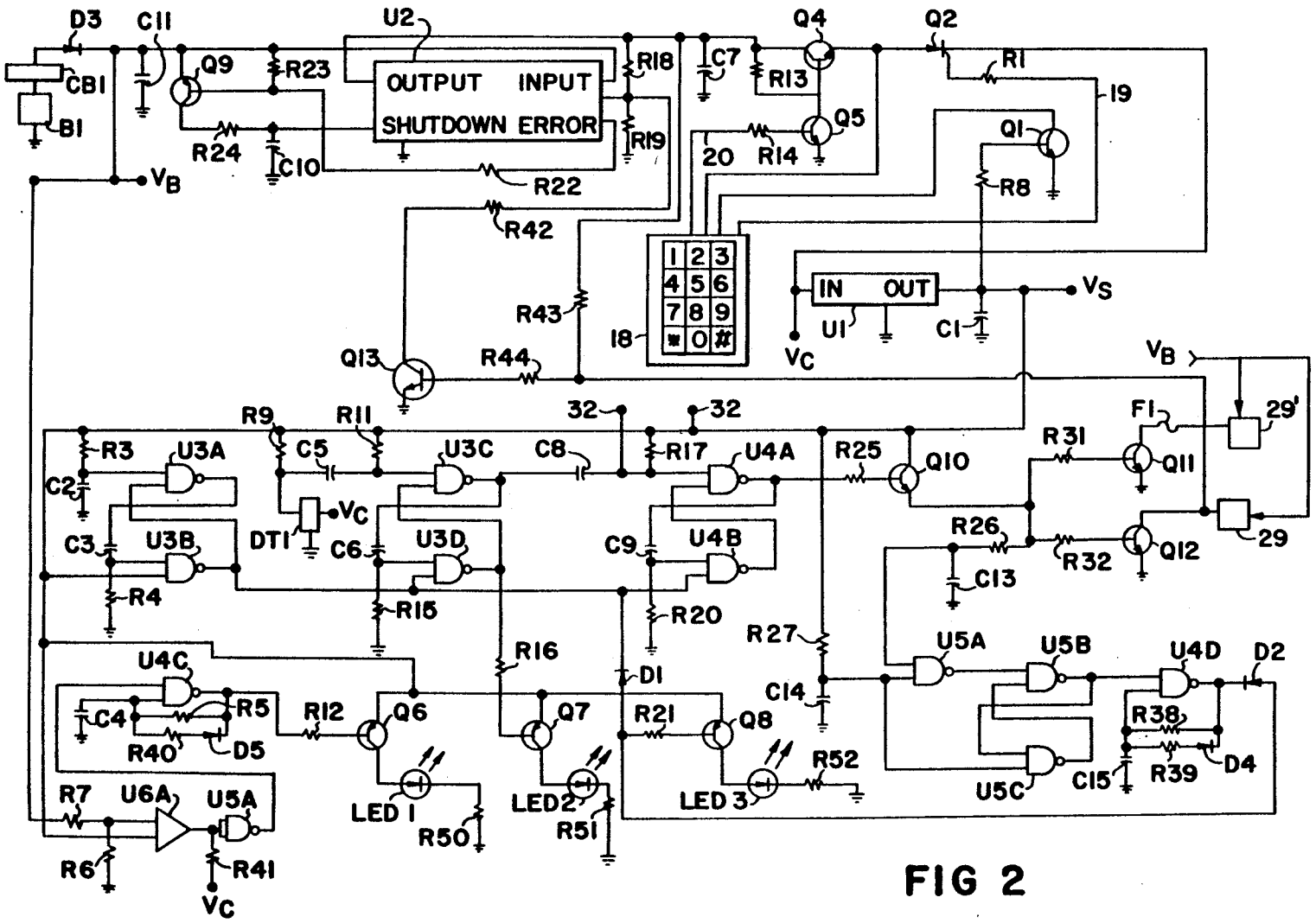
FIG. 2 is a general schematic diagram of the security system of FIG. 1.

With reference now to FIG. 2, the schematic diagram can be discussed. The battery B1 is a 12 volt rechargeable device connected via thermal circuit breaker CB1 to voltage regulator U2 which, along with R18, R19 and C7, make up the +10.4 vdc supply 15. Low voltage detection is provided by a National Semiconductor LP2951 voltage regulator, U2, sensing voltage via R18, R19. Q9 is responsive to an error signal from U2 and provides a shutdown signal to turn U2 off when B1 voltage is too low. The additional components depend upon the specific device used for U2. The setpoint for low voltage cutoff of U2 is established at +10.5 volts at which value the battery B1 needs charging.

The output voltage of battery B1 is also independently monitored by the warning circuit 13 comprising voltage dividers R6 and R7 which provide a signal to comparator U6A. Comparator U6A receives a +5.0 vdc signal from the output line of U1, the +5.0 vdc supply. When the voltage across R6 drops below +5.0 volts, the output of U6A goes Lo to energize yellow indicator LED 1 via Q6 and current limiter R12. The LED driver circuitry for LED1 consists of oscillator U4C having an m U6A via U5D.

Exit timer 28 consists of a multivibrator built around U3A, U3B which are NAND circuits employing Schmitt triggers for accuracy in timing and lowered sensitivity to spurious signals such as those induced by electrical storms. Power to the timer 28 is +5.0 vdc. The thirty-second time delay is established by the selection of C3 and R4 in the usual manner. The output signal of U3B remains Lo for the time delay interval in order to disable the time-out of timers 23 and 25 during this period. After time-out of timer 28, the system 10 will be in the armed or monitoring state.

The entry timer 23 also utilizes a NAND Schmitt multi-vibrator U3C, U3D which provides a Hi output signal from U3C for thirty seconds, the interval being set by C6 and R15. The output of U3C will go Lo after time-out with the result that a negative-going pulse through R17 and C8 will trip alarm timer 25.

The alarm timer 25 includes NAND gates U4A, U4B and C9, R20 and provides a Hi output signal for twenty minutes to alarm driver 26. Driver 26 includes R25 and Q10 to provide sufficient current amplification to drive power transistors Q11 and Q12 which act as current sinks for alarms 29' and 29. Base current balancing is accomplished via R31 and R32. Fuse F1 provides overcurrent protection. Alarm timer 25 includes terminals 32 which are used for an alternate input circuit that need not be discussed further in this application.

Entry indicator 24 includes red LED 2 which is energized via R16 and Q7 to indicate that the alarm system is in the entry mode. The arming and entry occurred indicator 31 includes green LED 3 which is operated (1) in a steady mode via D1, R21 and Q8 to indicate that the system 10 is in the arming state; or (2) in a flashing mode via flasher logic 30 to indicate during a monitoring state, that an entry occurred as a prior alarm state. The flasher logic consists of a low frequency oscillator U4D, R38, C15 which is enabled via the Q output of the flip-flop of U5B, U5C controlled by NAND gate U5A. U5A is connected to the alarm driver 26 at the output of Q10. The output of U4D is sent via D2 to Q8 and green indicator LED 3.

Control of the alarm system 10 is by way of keypad 18. An "arming command pulse" is placed on line 19 by simultaneously pressing the "*" and "#38 keys to route a positive voltage, supplied to keypad 18 via Q4, to current limiting resistor R1 which will gate SCR Q2 on. When Q2 is on, positive voltage is supplied to voltage regulator U1 which in turn supplies regulated +5.0 vdc to the various timing and control circuits. The keypad 18 is itself energized by providing a ground return path via the collector of Q1.

When power is supplied to the timing and control circuitry from U1, the exit timing sequence commences for the thirty-second period it will take for the charge of C3 through R4. LED 3 will be a steady green during this period.

The keypad 18 also provides a "reset command pulse" to output line 20 via an internal normally open relay (not shown) that will close when a predetermined 3- or 4- digit code is entered through the number keys. The reset command pulse is a positive voltage supplied to the base of Q5 via current limiter R14. Q5, which is normally OFF, is turned on to sink the base current of Q4 to ground and thereby turning it OFF. With Q4 OFF, the voltage at the anode of SCR Q2 drops, turning it OFF to remove input power to U1 and thus tripping power to the control circuitry. If the wrong code is entered, key "*" should be depressed to erase the internal code decoding circuitry to allow the proper code to be entered.

The functional operation of the portable alarm system 10 in a typical application is as follows:

the security system 10 includes a rigid housing 33 and is preferably mounted in a central location in a house or building under construction. The detector DT1 is a passive infrared device that provides a Hi output signal when a temperature change of +3° F. occurs within its operating range. Preferably, the detector DT1, which functions as a motion detector, is mounted 5–8 feet above the floor level.

When protection is desired, such as at night or on weekends, all the user has to do to arm the system is provide the proper input code by depressing the "*" and "#" keys on keypad 18 simultaneously. Keypad 18 is a Moose Products, Inc., MPI-711 digital remote control station programmable to provide a Hi output signal in response to specified operation of its keys. The arming command signal will be sent via line 19 to R1 to gate on Q2. Q2 operates as part of a switching circuitry to apply power in response to specified operation of its keys. When power is applied to the control and timing circuitry initially the system 10 is placed in the arming state. Exit timer 28 begins a thirty-second time delay by providing an alarm lockout Lo signal from U3B to U3D and U4B to inhibit the operation of entry timer 23 and alarm timer 25 during this time period. At the expiration of the thirty-second time delay the output of U3B goes Hi to terminate the previous alarm lockout signal; to turn off indicator LED 3; and to transfer the system 10 to the monitoring state. The system 10 can now be considered as being in the armed mode. When a Hi output from detector DT1 is inverted via C5, R9 and R11 to drive the input to U3C Lo for at least 0.1 sec., the entry time delay of entry timer 23 begins which transfers the system to the entry mode. Red LED 2 will be energized via U3D and an alarm lockout Hi signal from U3C to U4A will inhibit alarm activation for thirty seconds. During the entry time delay the intruder has thirty seconds in which to enter a 3- or 4- digit code into keypad 18 via the associated keys. The keypad 18 has an internal printed circuit board (not shown) with a perimeter area onto which removable metal clips can be placed to program the keypad 18. If the correct code is entered, keypad 18 will send a Hi output reset command signal via line 20 to Q5. Q4 and Q5 are part of the switching circuitry controlling power from the output terminal circuitry of U2. The correct disarm code will generate the reset signal to trip power downstream of Q4 to deenergize the control and timing circuits including detector DT1.

If the correct disarm code is not entered within the thirty-second time delay of the entry timer 23, the output of U3C will go Lo tripping U4A and transferring the system 10 to the alarm state for twenty minutes. The entry timer 23 is reset to its armed mode when the alarm lockout Hi signal to U4A is terminated (goes Lo).

U4A provides an alarm signal to the alarm driver 26 for twenty minutes which in turn causes siren 29 to be activated by the completion of the circuit from the battery B1 to ground via Q12 (and Q11 if alarm 29' is also used).

At the end of the twenty-minute alarm state, the output of U4A will go Lo turning off the alarms 29, 29' by removing the input to the alarm driver 26.

The exit timer 28, entry timer 23 and alarm timer 25 are monostable multivibrators built around Schmitt Trigger Circuits which reset automatically to their quiescent state after one cycle. The system 10 is reset to the armed mode of the monitoring state at the completion of an alarm state cycle. LED 3 will remain flashing. The alarm state time delay is set (1), to be within the time allowed by local ordinances for unattended alarm functions; and (2), to provide the limited alarm time which limits the energy consumption of the alarm function.

The code for the reset or disarm function is preferably kept secret to prevent unauthorized shutdown of the system 10.

Low voltage sensing via U2 will remove power to the alarm system circuitry on low voltage. Led 1 provides low voltage warning indication.

In addition to the normal detection described above, the detector DT1 will provide an output signal during a warm-up period when power is initially applied to the circuitry. During the warm-up period of approximately ten seconds, a detector DT1 output to entry timer gate U3C will cause the siren to "chirp" for about 0.02 seconds as determined by the response time of C8 and R17. Alarm timer 25 is inhibited by the Lo output from U3B to U4B and accordingly the alarm cycle is not initiated. The pulse is simply passed through driver 26. As the user moves about the protected area during the remaining twenty seconds of the arming period, the detector DT1 can provide other outputs which result in the same "chirping" action.

R26 and C14 and R27, C13 prevent the "chirping" action from triggering the entry occurred gate U5A. R26, C13 provide that an input to U5A will be Lo until the emitter of Q10 goes Hi for more than 0.1 second. R27 and C14 also hold an input to U5A Lo until Vs is high for more than 1.0 second as established by their time constant to prevent a power-up transient from tripping the entry occurred circuitry 30. It is not desirable to entirely eliminate the "chirping" as it does provide a valuable "self" feature for the alarm system 10.

For size and cost considerations, U3, U4, and U5 are quad NAND chips with a single Vs input per chip (not shown) which also simplifies circuit layout. Schmitt Trigger Circuitry provides for accuracy in timing and minimal susceptibility to spurious signals because of the accurate, narrow trigger levels as understood in the art. U6A is ¼ of a 339 quad comparator and also receives an input (not shown) from Vc.

The illustrated preferred embodiment of the present invention employs a single detector DT1 to indicate motion of an intruder by detecting a temperature change. It is to be understood that additional detectors and detectors of a different type could be used to provide the trip signal for U3C. In addition, while the various time delays are fixed, it is a simple matter to provide for adjustable time delays as understood in the art. Furthermore, keypad 18 is but one of a wide variety of devices that can create the respective arming and reset command pulses needed to control the switching circuitry employed in the present invention. Finally, main power in a building can be substituted for the battery B1. All that would be required is the appropriate voltage and the usual circuit connections.

In the preferred embodiment of the portable security alarm system 10 in accord with the present invention, the low voltage cutoff circuitry 12 includes state sensitive monitoring circuitry 12' which changes the low voltage cutoff setpoint between two predetermined values. First, when internal siren is OFF, that is the system is not in the alarm state, the low voltage cutoff value for the battery B1 is set at +10.5 vdc to protect the battery B1 from low voltages that can damage it during steady state operation. Second, a lower value of the low voltage cutoff value is used when alarms 29, 29' are energized, i.e., when the system 10 is in the alarm state. This lower voltage cutoff value is acceptable during load transients when high current drain naturally will reduce the battery B1 output voltage but will not necessarily damage the battery B1.

The state sensitive monitoring circuitry 12' includes Q13 with its base connected via current limiting resistor 44 to the collector of Q12 which is, in turn, connected through internal siren 29 to B1. The low voltage cutoff setpoint is proportional to the values of R18 and R19 which are connected to U2. When Q13 is on because Q12 is off, the low voltage cutoff value is determined by placing R42 in parallel with R19 to give a higher low voltage cutoff value. Now, Q12 is on when siren 29 is on and Q13 will be turned off. This effectively drops R42 from the parallel path of R19 leaving only R19 and R18 for the determination of the newer, lower low voltage cutoff setpoint. R43 is a pull-up resistor for the base of Q13.

In the preferred embodiment, the flasher logic of U4D, R38 and C15 incorporates energy conserving circuitry which includes the additional components of R39 and D4 to alter the duty cycle of the flasher unit to approximately 20% ON-time and 80% OFF-time from a roughly 50%-50% split than might otherwise be the case. Similar energy conservation circuits exist in U4C where the additional components of C4, R5, R40 and D5 will result in a duty cycle for the LED 1 driver of approximately 20% ON-time and 80% OFF-time. U4C is driven by U5D and R41 from comparator U6A. This circuitry uses less energy than if U6A drove Q6 directly and caused LED 1 to remain on continuously after detection of low voltage. Resistors R50, R51 and R52 limit current through the associated LEDs.

Functionally, the circuitry employed in the alarm system 10 can be further illustrated with reference again to FIG. 1 wherein electronic circuit means 34 includes detection circuit means 35 which uses a detector 22. Control circuitry 36 includes the time delay circuits 23, 25 and 28 and programmable circuit means 37 having manual entry means 38 in the way of keys on keypad 18. A direct current power source shown generally at 39 includes switching circuits 40 which control output terminal circuitry 41 represented by the two power supplies 15 and 17. The alarm circuitry 42 includes an audio alarm circuit 43 including internal and external sirens 29, 29'.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A portable security alarm system for detecting the presence of an intruder in a protected area comprising a direct current power source, an output terminal circuit means for receiving power from said source, said direct current power source including a battery and battery voltage sensing circuit means, said battery voltage sensing circuit means being operable to prevent power from being provided to said output terminal circuit means from said battery when the output voltage of said battery falls below a predetermined low voltage cutoff value as established be said battery voltage sensing circuit means, switching circuit means connected between said power source and said output terminal circuit means for selectively controlling power to said output terminal circuit means, alarm circuit means including an alarm connected to and selectively energized by said power source, and electronic circuit means connected to and selectively receiving power from said output terminal circuit means and connected to said alarm circuit means for selective energization of said alarm by said power source, said electronic circuit means including detecting circuit means for detecting the presence of an intruder in a protected area and providing a first output signal in response to the detection of an intruder, said electronic circuit means further including control circuit means responsive to said first output signal and selectively operating said system in one of a plurality of states and selectively transferring said system from said one state to another of said states; said plurality of states including an alarm state wherein said alarm is energized for a first time period in response to the detection of an intruder by said detection circuit means, a monitoring state wherein said system is responsive to the detection of an intruder by said detection circuit means, said system being transferable to said alarm state only after a second time period, and an arming state wherein said alarm is incapable of being energized during a third time period, said control circuit means including programmable circuit means connected to said switching circuit means and having manual entry means for providing an arming signal in response to a first predetermined method of operation of said manual entry means as programmed in said programmable circuit means, said switching circuit means being responsive to said arming signal to provide power from said power source to said output terminal circuit means when said arming signal is received, said electronic circuit means being energized when power is applied to said output terminal circuit means to allow said system to be operated selectively in said plurality of states by said control circuit means.

2. A portable security alarm system for detecting the presence of an intruder in a protected area comprising a battery, an output terminal circuit means for receiving power from said battery, switching circuit means connected between said battery and said output terminal circuit means for selectively controlling power to said output terminal circuit means, alarm circuit means including an alarm connected to and selectively energized by said battery and electronic circuit means connected to and selectively receiving power from said output terminal circuit means and connected to said alarm circuit means for selective energization of said alarm by said battery, said electronic circuit means including detecting circuit means for detecting the presence of an intruder in a protected area and providing a first output signal in response to the detection of an intruder, said electronic circuit means further including control circuit means responsive to said first output signal and selectively operating said system in one of a plurality of states and selectively transferring said system from said one state to another of said states; said plurality of states including an alarm state wherein said alarm is energized for a first time period in response to the detection of an intruder by said detection circuit means, a monitoring state wherein said system is responsive to the detection of an intruder by said detection circuit means, said system being transferable to said alarm state only after a second time period, and an arming state wherein said alarm is incapable of being energized during a third time period; said control circuit means including reset circuit means to limit the length of time said system is in said alarm state to said first time period to reduce the power consumption of said system by said alarm, said reset circuit means resetting said system to said monitoring state when said first time period is terminated by said reset circuit means, said switching circuit means being selectively operable to provide power from said battery to said output terminal circuit means, said electronic circuit means being energized when power is applied to said output terminal circuit means to allow said system to be operated selectively in said plurality of states by said control circuit means, said electronic circuit means further including a battery voltage sensing circuit to provide visual indication when the voltage of said battery falls below a predetermined low voltage value as established by said battery voltage sensing circuit, said battery voltage circuit means including an oscillator and a light source connected to said oscillator, said oscillator operating said light in on )N-OFF duty cycle of approximately 20%-80% respectively, to reduce the power consumption of said system when said sensing circuit means is providing indication that the voltage of said battery is below said low voltage value.

3. A portable security alarm system for detecting the presence of an intruder in a protected area comprising a battery, an output terminal circuit means for receiving power from said battery, switching circuit means connected between said battery and said output terminal circuit means for selectively controlling power to said output terminal circuit means, alarm circuit means including an alarm connected to and selectively energized by said battery and electronic circuit means connected to and selectively receiving power from said output terminal circuit means and connected to said alarm circuit means for selective energization of said alarm by said battery, said electronic circuit means including detecting circuit means for detecting the presence of an intruder in a protected area and providing a first output signal in response to the detection of an intruder, said electronic circuit means further including control circuit means responsive to said first output signal and selectively operating said system in one of a plurality of states and selectively transferring said system from said one state to another of said state, said plurality of states including an alarm state wherein said alarm is energized for a first time period in response to the detection of an intruder by said detection circuit means, a monitoring state wherein said system is responsive to the detection of an intruder by said detection circuit means, said system being transferable to said alarm sate only after a second time period, and an arming state wherein said alarm is incapable of being energized during a third time period, said control circuit means including reset circuit means to limit the length of time said system is in said alarm state to said first time period to reduce the power consumption of said system by said alarm, said reset circuit means resetting said system to said monitoring state when said first time period is terminated by said reset circuit means, said switching circuit means being selectively operable to provide power from said battery to said output terminal circuit means, said electronic circuit means being energized when power is applied to said output terminal circuit means to allow said system to be operated selectively in said plurality of states by said control circuit means, said electronic circuit means including indicating circuit means for providing visual indication that said system has been operated in said alarm state, said indicating circuit means including an oscillator and a light source connected to said oscillator, said oscillator operating said light in an ON-OFF duty cycle of approximately 20%-80% respectively, to reduce the power consumption of said system when said indicating circuit means is providing indication that said system has been operated in said alarm state.

4. A portable security alarm system for detecting the presence of an intruder in a protected area comprising a direct current power source, alarm circuit means including an alarm connected to and selectively energized by said power source and electronic circuit means connected to and selectively receiving power from said power source and connected to said alarm circuit means for selective energization of said alarm by said power source, said electronic circuit means including detecting circuit means for detecting the presence of an intruder in a protected area and providing a first output signal in response to the detection of an intruder, said electronic circuit means further including control circuit means responsive to said first output signal and selectively operating said system in one of a plurality of states and selectively transferring said system from said one state to another of said states, said plurality of states including an alarm state wherein said alarm is energized only for a predetermined first time period as established by said control circuit means in response to the detection of an intruder by said detection circuit means, a monitoring state wherein said system is responsive to the detection of an intruder by said detection circuit means, said system being transferable to said alarm state, and an arming state wherein said alarm is incapable of being energized during a second time period, said control circuit means including switching circuit means connected between said electronic circuit means and said power source to provide power from said power source to said electronic circuit means to allow said system to be operated selectively in said plurality of states by said control circuit means, said direct current power source including a battery and battery voltage sensing circuit means, said battery voltage sensing circuit means being operable to remove power from said electronic circuit means from said battery when the output voltage of said battery falls below a first predetermined low voltage cutoff value as established by said battery voltage sensing circuit means.

5. A portable security alarm system for detecting the presence of an intruder in a protected area comprising a direct current power course, an output terminal circuit means for receiving power from said source, switching circuit means connected between said power source and said output terminal circuit means for selectively controlling power to said output terminal circuit means, alarm circuit means including an alarm connected to and selectively energized by said power source, electronic circuit means connected to and selectively receiving power from said output terminal circuit means and connected to said alarm circuit means for selective energization of said alarm by said power source, said electronic circuit means including detecting circuit means for detecting the presence of an intruder in a protected area and providing a first output signal in response to the detection of an intruder, said electronic circuit means further including control circuit means responsive to said first output signal and selectively operating said system in one of a plurality of states and selectively transferring said system from said one state to another of said states; said plurality of states including an alarm state wherein said alarm is energized for a first time period in response to the detection of an intruder by said detection circuit means, a monitoring state wherein said system is responsive to the detection of an intruder by said detection circuit means, and being transferable to said alarm state only after a second time period, and an arming state wherein said alarm is incapable of being energized during a third time period, said control circuit means including programmable circuit means connected to said switching circuit means and having manual entry means for providing an arming signal in response to a first predetermined method of operation of said manual entry means as programmed in said programmable circuit means, said switching circuit means being responsive to said arming signal to provide power from said power source to said output terminal circuit means when said arming signal is received, said electronic circuit means including indicator means for providing visual indication of said system being operated in said arming state, said indicator being OFF when said system is in said monitoring state, said electronic circuit means being energized when power is applied to said output terminal circuit to allow said system to be operated selectively in said plurality of state by said control circuit means, said programmable circuit means providing a reset command signal to said switching circuit means in response to a second predetermined method of operation of said manual entry means as programmed in said programmable circuit means, said switching circuit means being responsive to said reset command signal to remove power from said output terminal circuit to prevent operation of said system in said alarm state.

6. The security alarm system as defined in claim 5 wherein said programmable circuit means is a programmable digital controller providing said reset command signal only when a predetermined code is entered by sequential operation of said manual entry means.

7. A portable security alarm system for detecting the presence of an intruder in a protected area comprising a direct current power course, an output terminal circuit means for receiving power from said source, switching circuit means connected between said power source and said output terminal circuit means for selectively controlling power to said output terminal circuit means, alarm circuit means including an alarm connected to and selectively energized by said power source, electronic circuit means connected to and selectively receiving power from said output terminal circuit means and connected to said alarm circuit means for selective energization of said alarm by said power source, said electronic circuit means including detecting circuit means for detecting the presence of an intruder in a protected area and providing a first output signal in response to the detection of an intruder, said electronic circuit means further including control circuit means responsive to said first output signal and selectively operating said system in one of a plurality of states and selectively transferring said system from said one state to another of said states; said plurality of states including an alarm state wherein said alarm is energized for a first time period in response to the detection of an intruder by said detection circuit means, a monitoring state wherein said system is responsive to the detection of intruder by said detection circuit means, and being transferable to said alarm state only after a second time period, and an arming state wherein said alarm is incapable of being energized during a third time period, said control circuit means including programmable circuit means connected to said switching circuit means and having manual entry means for providing an arming signal in response to a first predetermined method of operation of said manual entry means as programmed in said programmable circuit means, said switching circuit means being responsive to said arming signal to provide power from said power source to said output terminal circuit means when said arming signal is received, said electronic circuit means including indicator means for providing visual indication of said system being operated in said arming state, said indicator being OFF when said system is in said monitoring state, said electronic circuit means being energized when power is applied to said output terminal circuit to allow said system to be operated selectively in said plurality of states by said control circuit means, said programmable circuit means being a programmable digital controller providing an output signal only when a predetermined code is entered by operation of said manual entry means.

8. A portable security alarm system for detecting the presence of an intruder in a protected area comprising a direct current power source having a visual indicator means operative ON to indicate power available from said source is below a predetermined value as established by said indicator and inoperative ON when the power available from said source is above said predetermined value, an output terminal circuit means for receiving power from said source, switching circuit means connected between said power source and said output terminal circuit means for selectively controlling power to said output terminal circuit means, alarm circuit means including an alarm connected to and selectively energized by said power source, electronic circuit means connected to and selectively receiving power from said output terminal circuit means and connected to said alarm circuit means for selective energization of said alarm by said power source; said electronic circuit means including detecting circuit means of detecting the presence of an intruder in a protected area and providing a first output signal in response to the detection of an intruder, said electronic circuit means further including control circuit means responsive to said first output signal and selectively operating said system in one of a plurality of states and selectively transferring said system from said one state to another of said states; said plurality of states including an alarm state wherein said alarm is energized for a first time period in response to the detection of an intruder by said detection circuit means, a monitoring state wherein said system is responsive to the detection of an intruder by said detection circuit means, and being transferable to said alarm state only after a second time period, and an arming state wherein said alarm is incapable of being energized during a third time period; said control circuit means including programmable circuit means connected to said switching circuit means and having manual entry means for providing an arming signal in response to a first predetermined method of operation of said manual entry means as programmed in said programmable circuit means, said switching circuit means being responsive to said arming signal to provide power from said power source to said output terminal circuit means when said arming signal is received, said electronic circuit means being energized when power is applied to said output terminal circuit to allow said system to be operated selectively in said plurality of states by said control circuit means, said electronic circuit means including indicator means for providing visual indication of said system being operated in said arming state.

9. The security alarm system as defined in claim 8 wherein said control circuit means includes first time delay circuit means for operating said system in said alarm state during said first time period as established by said first time delay circuit means, said first time delay circuit means providing an alarm output signal to said alarm circuit means for energizing said alarm for the duration of said first time period.

10. The security alarm system as defined in claim 9 wherein said first time delay circuit means includes first reset circuit means to reset said first time delay circuit means to terminate said alarm output signal and transfer said system to the monitoring state after the completion of said first time period.

11. The security alarm system as defined in claim 9 wherein said control circuit means includes second time delay circuit means operative in response to a said first output signal when said system is in said monitoring state, said second time delay circuit means providing an alarm lockout signal to said first time delay circuit means for the duration of said second period to prevent said first time delay circuit means from providing said alarm output signal during said second time period.

12. The security alarm system as defined in claim 11 wherein said second time delay circuit means operates in an "entry" mode during said second time period and operates in an "armed" mode prior to said "entry" mode when said system is being operated in said monitoring state, said second time delay circuit means including reset circuit means to reset said second time delay circuit means to said "armed" mode at the end of said second time period, without providing said alarm lockout signal.

13. The security alarm system as defined in claim 11 wherein said control circuit means includes third time delay circuit means for operating said system in said arming state during said third time period as established by said third time delay circuit means, said third time delay circuit means providing a second alarm lockout signal to said first time delay circuit means for the duration of said third time period to prevent said first time delay circuit means from providing said alarm output signal during said third time period.

14. The security alarm system as defined in claim 13 wherein said third time delay circuit means is responsive to the application of power to said electronic circuit means by said switching circuit means to begin said third time period when said arming signal is provided to said switching circuit means by said programmable circuit means.

15. The security alarm system as defined in claim 13 wherein said third time delay circuit means provides a state transfer signal at the end of said third time period to operate said system in said monitoring state, said second time delay circuit means being responsive to said state transfer signal to operate said system in the monitoring state after receiving said signal, said third time delay circuit means terminating said second alarm lockout signal at the end of said third time period.

16. The security alarm system as defined in claim 15 wherein said second time delay circuit means is responsive to said first output signal from said detection circuit means when said system has been transferred to said monitoring state to commence said second time period when said first output signal is received.

17. The security alarm system as defined in claim 16 wherein said second time delay circuit means provides a second state transfer signal at the end of said second time period to operate said system in said alarm state, said first time delay circuit means being responsive to said second state transfer signal to provide said alarm output signal to said alarm circuit means to energize said alarm during said first time period, said first time period beginning when said first time delay circuit means receives said second state transfer signal.

18. The security alarm system as defined in claim 17 wherein said control circuit means includes state reset circuit means to transfer said system to said monitoring state at the end of said first time delay period.

19. The security alarm system as defined in claim 8 wherein said detection circuit means includes a motion detector for providing said output signal when the presence of an intruder is detected as motion within a protected area.

20. The security alarm system as defined in claim 8 wherein said electronic circuit means includes indicator means for providing visual indication that said system has been operated in said alarm state.

21. The security alarm system as defined in claim 8 wherein said control circuit means includes energy conserving circuit means to reduce the power consumption of said system, said energy conserving circuit means including reset circuit means to limit the length of time said system is in said alarm state to said first predetermined time period by resetting said system to said monitoring state after said system has been operated in said alarm state for said first predetermined time period as established by said energy conserving circuit means.

22. A portable security alarm system for detecting the presence of an intruder in a protected area comprising a direct current power course, an output terminal circuit means for receiving power from said source, switching circuit means connected between said power source and said output terminal circuit means for selectively controlling power to said output terminal circuit means, alarm circuit means including an alarm connected to and selectively energized by said power source, electronic circuit means connected to and selectively receiving power from said output terminal circuit means and connected to said alarm circuit means for selective energization of said alarm by said power source, said electronic circuit means including detecting circuit means for detecting the presence of an intruder in a protected area and providing a first output signal in response to the detection of an intruder, said electronic circuit means further including control circuit means responsive to said first output signal and selectively transferring said system from said one state to another of said states; said plurality of states including an alarm state wherein said alarm is energized for a first time period in response to the detection of an intruder by said detection circuit means, a monitoring state wherein said system is responsive to the detection of an intruder by said detection circuit means, and being transferable to said alarm state only after a second time period, and an arming state wherein said alarm is incapable of being energized during a third time period, said control circuit means including programmable circuit means connected to said switching circuit means and having manual entry means for providing an arming signal in response to a first predetermined method of operation of said manual entry means as programmed in said programmable circuit means, said switching circuit means being responsive to said arming signal to provide power from said power source to said output terminal circuit means when said arming signal is received, said electronic circuit means including indicator means for providing visual indication of said system being operated in said arming state, said indicator being OFF when said system is in said monitoring state, said electronic circuit means being energized when power is applied to said output terminal circuit to allow said system to be operated selectively in said plurality of states by said control circuit means, said detection circuit means including an infrared detector for providing said first output signal when the presence of an intruder is detected as a temperature change in a protected area.

23. A portable security alarm system for detecting the presence of an intruder in a protected area comprising a direct current power source, alarm circuit means including an alarm connected to and selectively energized by said power source and electronic circuit means connected to and selectively receiving power from said power source and connected to said alarm circuit means for selective energization of said alarm by said power source, said electronic circuit means including detecting circuit means for detecting the presence of an intruder in a protected area and providing a first output signal in response to the detection of an intruder, said electronic circuit means further including control circuit means responsive to said first output signal and selectively operating said system in one of a plurality of states and selectively transferring said system to said one state to another of said states, said plurality of states including an alarm state wherein said alarm is energized only for a predetermined first time period as established by said control circuit means in response to the detection of an intruder by said detection circuit means, a monitoring state wherein said system is responsive to the detection of an intruder by said detection circuit means said system being transferable to said alarm state, and an arming state wherein said alarm is incapable of being energized during a second time period; said control circuit means including switching circuit means connected between said electronic circuit means and said power source to provide power from said power source to said electronic circuit means to allow said system to be operated selectively in said plurality of states by said control circuit means, said direct current power source including a battery and battery voltage sensing circuit means, said battery voltage sensing circuit means being operable to remove power from said electronic circuit means from said battery when the output voltage of said battery falls below a first predetermined low voltage cutoff value as established by said battery voltage sensing circuit means, said control circuit means including energy conserving circuit means to reduce the power consumption of said system, said energy conserving circuit means including reset circuit means to limit the length of time said system is in said alarm state to said first predetermined time period by resetting said system to said monitoring state after said system has been operated in said alarm state for said first predetermined time period as established by said energy conserving circuit means.

24. A portable security alarm system for detecting the presence of an intruder in a protected area comprising a direct current power source, alarm circuit means including an alarm connected to and selectively energized by said power source and electronic circuit means connected to and selectively receiving power from said power source and connected to said alarm circuit means for selective energization of said alarm by said power source, said electronic circuit means including detecting circuit means for detecting the presence of an intruder in a protected area and providing a first output signal in response to the detection of an intruder, said electronic circuit means further including control circuit means responsive to said first output signal and selectively operating said system in one of a plurality of states and selectively transferring said system from said one state to another of said states, said plurality of states including an alarm state wherein said alarm is energized only for a predetermined first time period as established by said control circuit means in response to the detection of an intruder by said detection circuit means, a monitoring state wherein said system is responsive to the detection of an intruder by said detection circuit means said system being transferable to said alarm state, an arming state wherein said alarm is incapable of being energized during a second time period; said control circuit means including switching circuit means connected between said electronic circuit means and said power source to provide power from said power source to said electronic circuit means to allow said system to be operated selectively in said plurality of states by said control circuit means, said direct current power source including a battery and battery voltage sensing circuit means, said battery voltage sensing circuit means being operable to remove power from said electronic circuit means from said battery when the output voltage of said battery falls below a first battery voltage sensing circuit means, said battery voltage sensing circuit being operable to remove power to said electronic circuit means from said battery when the voltage of said battery falls below a second predetermined low voltage cutoff value as established by said sensing circuit, said sensing circuit means including state-sensitive circuit means operatively connected to be responsive to said control circuit means transferring said system to said alarm state for changing said low voltage cutoff value from said first predetermined value to said second predetermined value when said control circuit means transfers said system to said alarm state.

* * * * *